US009027169B2

(12) United States Patent
Turner

(10) Patent No.: US 9,027,169 B2
(45) Date of Patent: May 12, 2015

(54) APPAREL WITH REDUCED FRICTION ZONES

(75) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1374 days.

(21) Appl. No.: 12/163,502

(22) Filed: Jun. 27, 2008

(65) Prior Publication Data

US 2009/0320174 A1 Dec. 31, 2009

(51) Int. Cl.
*A41D 13/00* (2006.01)
*A41D 13/05* (2006.01)

(52) U.S. Cl.
CPC ..... *A41D 13/0506* (2013.01); *A41D 2400/24* (2013.01)

(58) Field of Classification Search
USPC ..... 2/22, 23, 227, 228, 238, 400, 465
See application file for complete search history.

(56) References Cited

U.S. PATENT DOCUMENTS

| | | | | | |
|---|---|---|---|---|---|
| 2,516,598 | A | * | 7/1950 | Selkirk | 2/465 |
| 4,035,844 | A | | 7/1977 | Atack et al. | |
| 4,156,294 | A | * | 5/1979 | Horn | 2/400 |
| 4,462,115 | A | * | 7/1984 | Carlson et al. | 2/465 |
| 4,700,407 | A | * | 10/1987 | Mattila | 2/465 |
| 4,887,811 | A | | 12/1989 | Tresh | |
| 4,894,867 | A | * | 1/1990 | Ceravolo et al. | 2/238 |
| 4,987,613 | A | * | 1/1991 | Loverdi et al. | 2/23 |
| 5,134,726 | A | * | 8/1992 | Ross | 2/465 |
| 5,365,610 | A | * | 11/1994 | Lubahn et al. | 2/23 |
| 5,551,082 | A | * | 9/1996 | Stewart et al. | 2/465 |
| 5,689,836 | A | * | 11/1997 | Fee et al. | 2/465 |
| 6,532,599 | B1 | * | 3/2003 | Dugan | 2/228 |
| 6,637,036 | B2 | | 10/2003 | Beland | |
| 6,804,832 | B2 | | 10/2004 | Beland | |
| 6,874,337 | B2 | * | 4/2005 | Uno et al. | 66/177 |
| 7,082,621 | B1 | * | 8/2006 | Fratesi | 2/227 |
| 7,412,731 | B1 | * | 8/2008 | Brassill | 2/456 |
| 7,500,274 | B1 | * | 3/2009 | Kallen | 2/227 |
| 7,891,026 | B1 | * | 2/2011 | Smith | 2/465 |
| RE42,689 | E | * | 9/2011 | Taylor | 156/265 |
| 2004/0016043 | A1 | * | 1/2004 | Uno et al. | 2/400 |
| 2008/0222766 | A1 | * | 9/2008 | Arensdorf et al. | 2/22 |

* cited by examiner

*Primary Examiner* — Richale Quinn
(74) *Attorney, Agent, or Firm* — Shook, Hardy & Bacon, L.L.P.

(57) ABSTRACT

An article of apparel may include a base layer and a cover layer. The cover layer may be stitchlessly-secured to an exterior surface of the base layer and positioned to extend along a side area and from a pelvic region to a leg region of the base layer. A width of the cover layer may be greater in the pelvic region than the first leg region. In some configurations, a frictional resistance of the exterior surface of the base layer may be greater than a frictional resistance of a surface of the cover layer.

23 Claims, 12 Drawing Sheets

APPAREL WITH REDUCED FRICTION ZONES

BACKGROUND

Many athletic activities involve actions that include sliding against the ground or another playing surface. In baseball and softball, for example, an athlete may slide when approaching a base in order to avoid contact with a member of an opposing team. In soccer, an athlete may slide to kick a soccer ball away from a member of an opposing team. In American football, an athlete (e.g., a quarterback) may slide when possessing a football to avoid being tackled by a member of an opposing team. Accordingly, sliding may be utilized as an effective offensive or defensive action in a variety of athletic activities.

Although sliding against the ground may be executed in a variety of ways, a common method of sliding is performed by inducing at least one of the legs to extend outward in front of the athlete. More particularly, the athlete may be running or otherwise moving in a particular direction. The athlete then lowers toward the ground such that the legs extend outward in front of the athlete and in the direction of movement. As the athlete transitions between running and sliding, the primary point of contact between the athlete and the ground shifts from the feet to the hip area. That is, the primary point of contact when sliding may be the area corresponding with a joint between the femur and the pelvis (i.e., the femoral joint). Other portions of the athlete, including sides of the legs, hands, and arms may also contact the ground.

An athlete may incur a variety of injuries from sliding. As an example, impact between the body of the athlete (e.g., at the femoral joint) and the ground may cause bruising or other types of compressive injuries. As another example, clothing may rub against skin of the athlete (e.g., at the femoral joint) and cause friction burns or abrasive injuries. Although either of these injuries may occur from sliding, athletes commonly perform slides and risk these injuries during athletic competitions or practice sessions.

SUMMARY

An article of apparel is disclosed below as including a base layer and a cover layer. The base layer has a pelvic region, a first leg region extending from the pelvic region, and a second leg region extending from the pelvic region. In addition, the base layer has an interior surface for contacting a wearer and an opposite exterior surface that faces away from the wearer. The cover layer is secured to the exterior surface of the base layer and positioned to extend from a side area of the pelvic region to a side area of the first leg region. A width of the cover layer may be greater in the pelvic region than the first leg region. In some configurations, a frictional resistance of the exterior surface of the base layer is greater than a frictional resistance of a surface of the cover layer.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
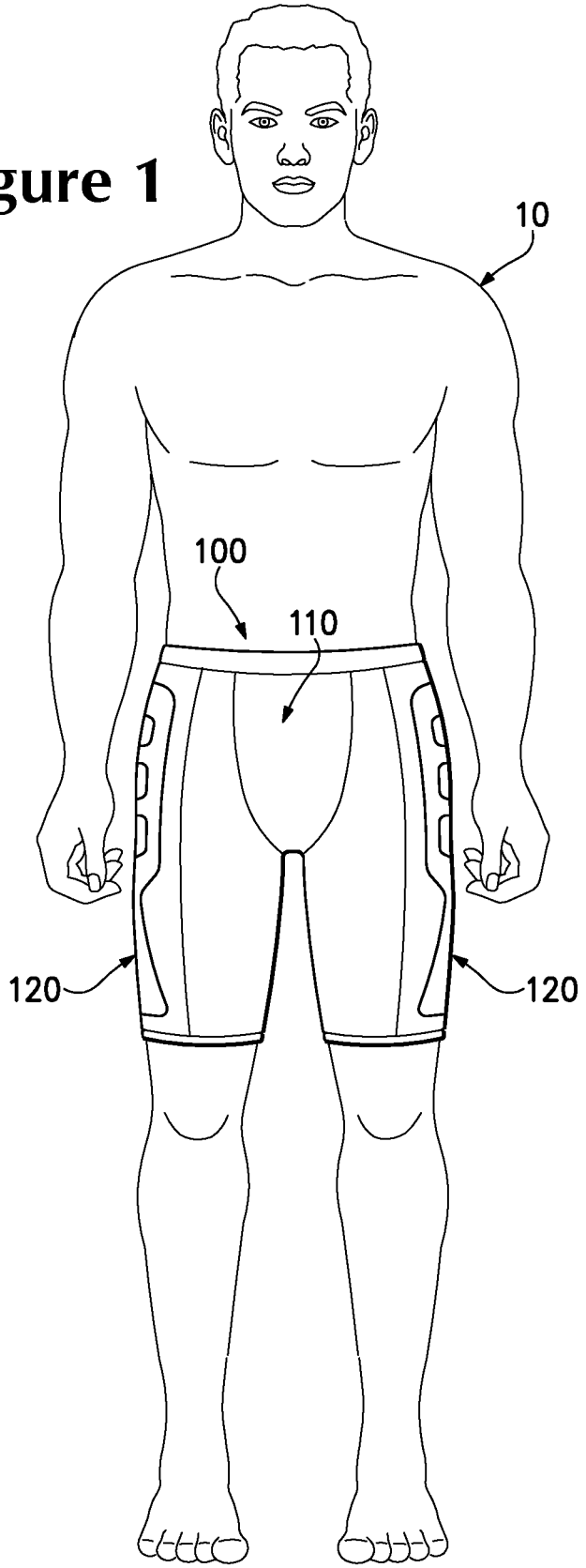
FIG. 1 is a front elevational view of an individual wearing a first article of apparel.
Figure 2:
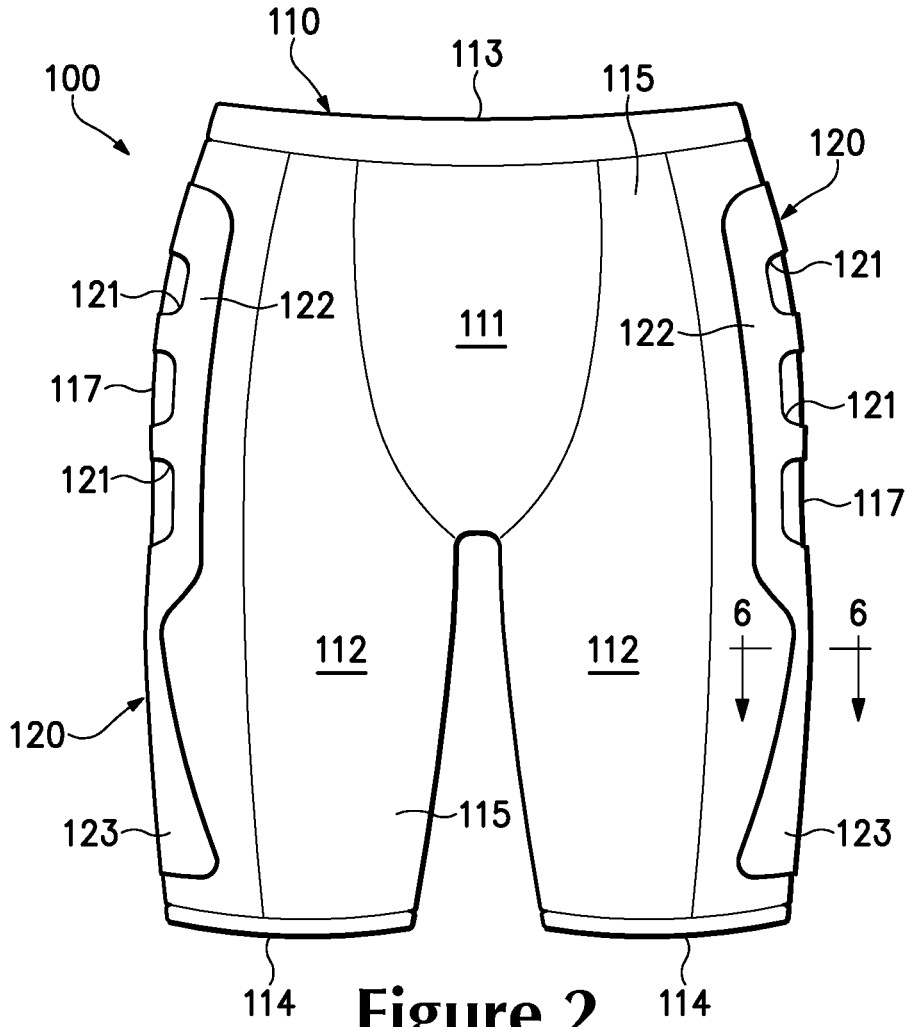
FIG. 2 is a front elevational view of the first article of apparel.

The following discussion and accompanying figures disclose various articles of apparel. With reference to FIG. 1, an individual 10 is depicted as wearing an article of apparel 100 with the general configuration of a shorts-type undergarment, but may have the configuration of other types of garments. Although apparel 100 may be worn under other articles of apparel, apparel 100 may be worn alone, may be exposed, or may be worn over other articles of apparel. Accordingly, the configuration of apparel 100 and the manner in which apparel 100 is worn by individual 10 may vary significantly.

Apparel 100 is depicted individually in FIGS. 2-5 as including a base layer 110 and a pair of cover layers 120 that are secured to base layer 110. Whereas base layer 110 imparts the general configuration of the shorts-type undergarment to apparel 100, cover layers 120 impart relatively low friction areas to apparel 100. As discussed in the Background section above, an athlete may incur a variety of injuries from sliding, including friction burns or abrasive injuries that arise when clothing rubs against skin of the athlete (e.g., at the femoral joint and sides of the legs). Cover layers 120 are located on base layer 110 at positions that correspond with the femoral joints and sides of the legs of individual 10 (or other individual wearing apparel 100) to reduce the degree to which base layer 110 causes friction burns or abrasive injuries at the femoral joints and legs during sliding.

Base layer 110 defines a pelvic region 111 and a pair of leg regions 112. Whereas pelvic region 111 has a configuration that covers portions of a pelvis of individual 10, leg regions 112 extend downward and are configured to cover portions of legs of individual 10. An upper area of pelvic region 111 defines a waist opening 113, and lower areas of leg regions 112 define a pair of leg openings 114. Base layer 110 also includes a front area 115, an opposite rear area 116, and a pair of side areas 117. Regions 111-112 and areas 115-117 are not intended to demarcate precise regions and areas of base layer 110. Rather, regions 111-112 and areas 115-117 are intended to represent general portions and areas of base layer 110 to aid in the following discussion.

A variety of materials and construction methods may be utilized for base layer 110. As an example of one configuration, base layer 110 may be formed from a plurality of textile elements that are stitched or otherwise joined together to form pelvic region 111 and leg regions 112. Although the textile elements forming a majority of pelvic region 111 and leg regions 112 may include materials that stretch to conform with the shape of individual 10, an area that circumscribes waist opening 113 (i.e., a waistband) may include a material that stretches to a greater degree. In other configurations, base layer 110 may be knitted as a one-piece element that does not include seams or other discontinuities. In further configurations, a majority of base layer 110 may be knitted as a one-piece element, but a separate waistband may be subsequently added. Accordingly, the configuration of base layer 110 may vary to include a variety of conventional or non-conventional designs.

Cover layers 120 are secured to an exterior surface of base layer 110 and located on side areas 117 and at positions that correspond with the femoral joints and sides of the legs. As noted above, cover layers 120 impart relatively low friction areas to apparel 100. When individual 10 performs a slide, cover layers 120 permit other articles of apparel (e.g., pants covering apparel 100) to move relative to apparel 100. If, for example, other articles of apparel catch upon apparel 100 and induce apparel 100 to move across the skin of individual 10, then apparel 100 may cause friction burns or abrasive injuries at areas of contact with individual 10. The relatively low friction areas imparted by cover layers 120, however, reduce the degree to which the other articles of apparel catch upon apparel 100. That is, cover layers 120 impart relatively low friction areas to apparel 100 at the femoral joint and sides of the legs, thereby reducing the degree to which apparel 100 may cause individual 10 to incur friction burns or abrasive injuries.

Figure 7:
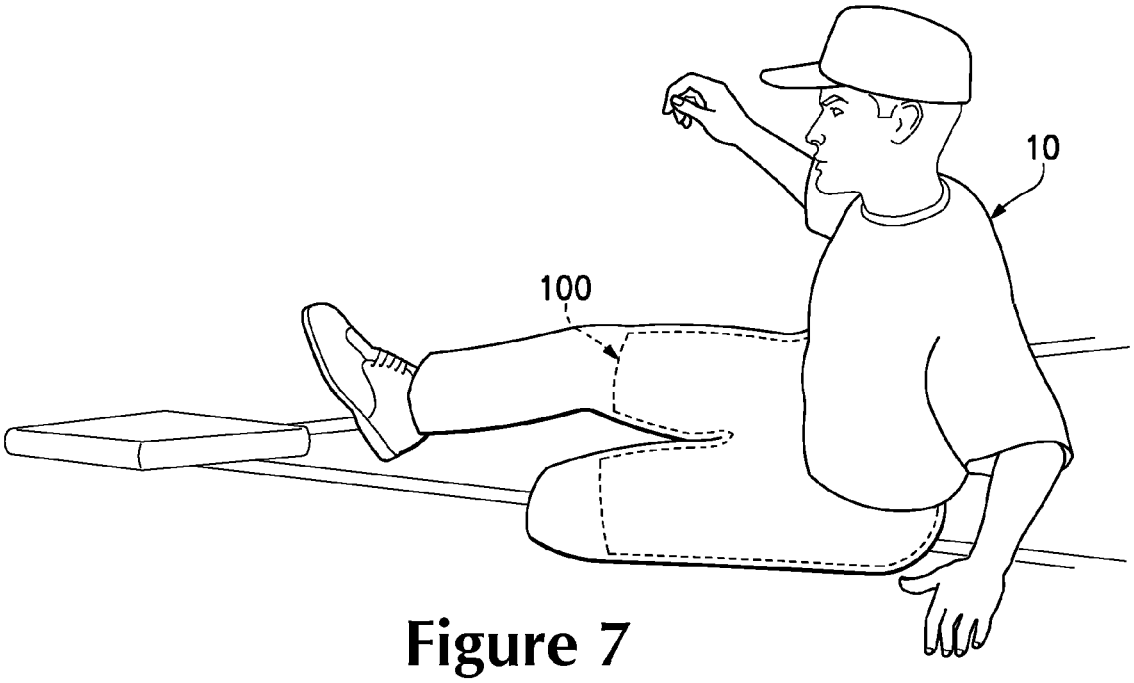
FIG. 7 is a perspective view of the individual performing a sliding action while wearing the first article of apparel.

While performing a slide, as depicted in FIG. 7, a side of at least one of the legs of individual 10 is in contact with the ground, but the primary point of contact between individual 10 and the ground may be the area corresponding with the femoral joint. Each of cover layers 120 extend from an upper area of pelvic region 111 to a lower area of one of leg regions 112, thereby being positioned in the area of contact with the ground. The widths of cover layers 120 are, however, greater in pelvic region 111 than in leg regions 112. Cover layers may, therefore, taper between pelvic region 111 and leg regions 112. In this configuration, cover layers 120 exhibit greater widths in areas corresponding with the femoral joints. Accordingly, cover layers 120 are positioned to correspond with the area of contact with the ground, but wider areas of cover layers 120 correspond with the femoral joints in order to also cover the primary point of contact with the ground.

Figure 3:
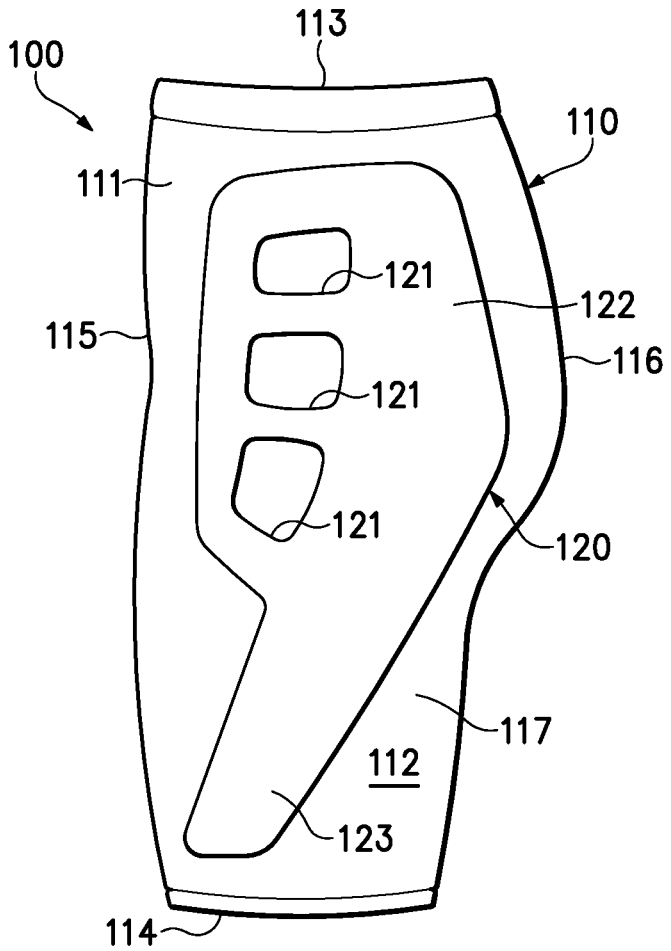
FIGS. 3 and 4 are side elevational views of the first article of apparel.
Figure 4:
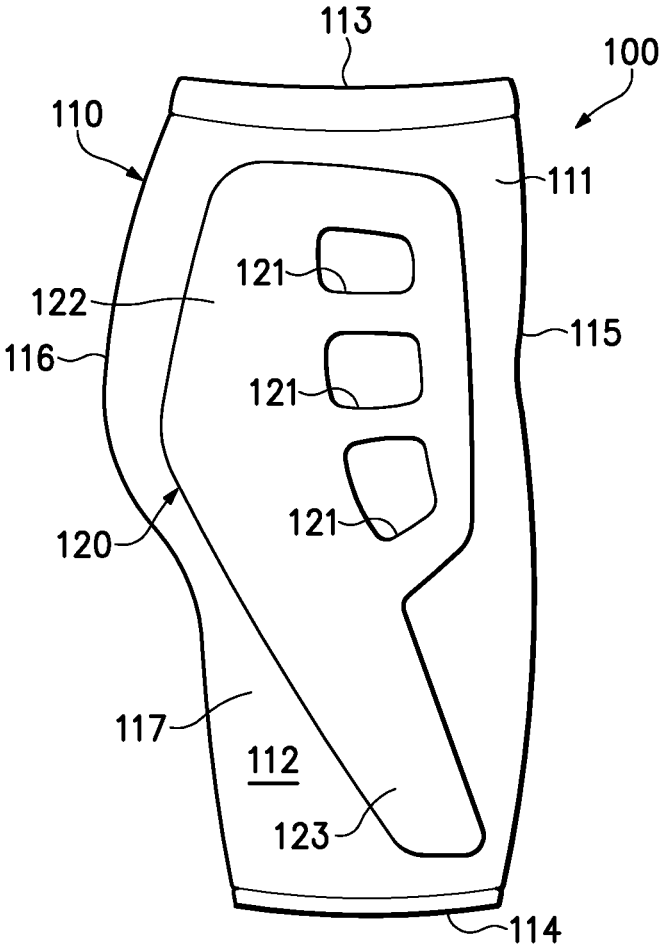
Figure 5:
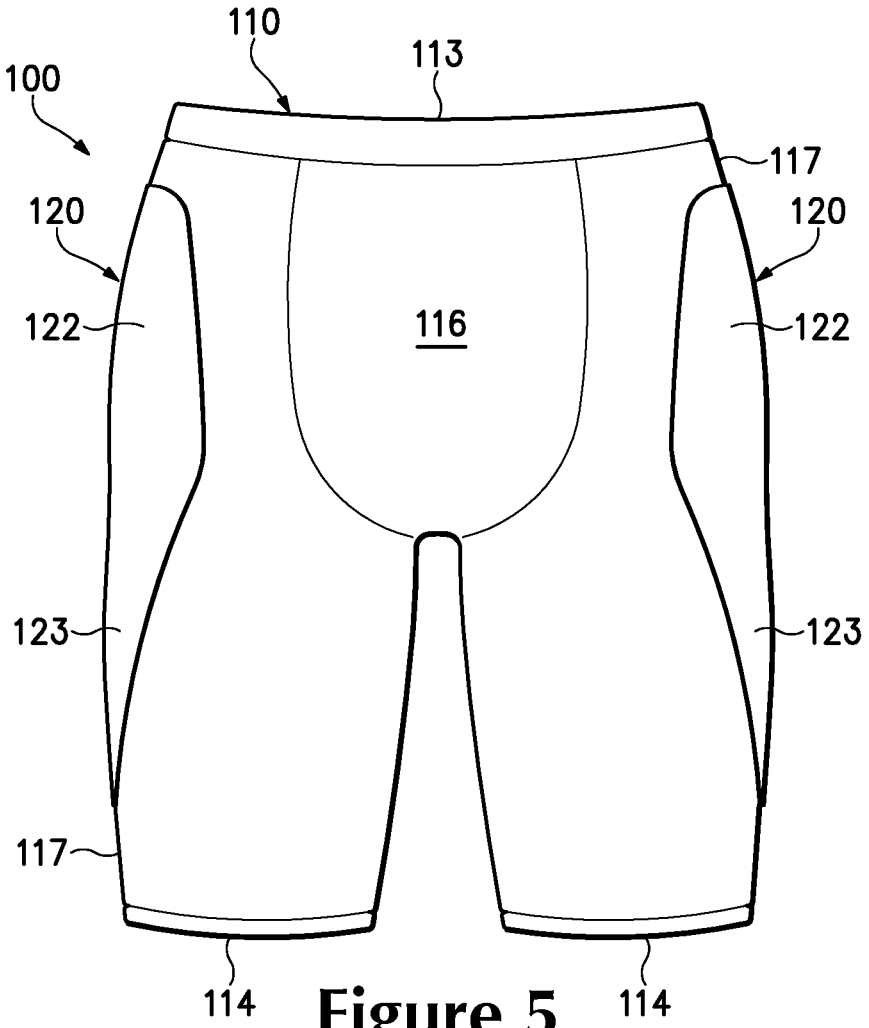
FIG. 5 is a rear elevational view of the first article of apparel.

During a slide, individual 10 may also be oriented such that a lateral area of the gluteus maximus muscle is in contact with the ground, also as depicted in FIG. 7. That is, a portion of the buttocks may also be in contact with the ground. As a result, portions of cover layers 120 are located in or proximal to rear area 116. More particularly, a majority of the areas of cover layers 120 are located in or proximal to rear area 116, rather than in front area 115. Referring to FIGS. 3 and 4, for example, cover layers 120 extend rearward and around rear area 116 to further correspond with the area of contact with the ground.

Based upon the above discussion, each of cover layers 120 are depicted as having (a) a position corresponding with the femoral joints and sides of the legs, (b) a tapered configuration, (c) greater width in the areas corresponding with the femoral joints, and (d) greater coverage in rear area 116 than front area 115. Given these parameters, the specific shapes of cover layers 120 may vary significantly. As depicted in the figures, for example, cover layers 120 have shapes that resemble the numeral nine (i.e., "9") with three apertures 121. That is, cover layers 120 each have a generally bulbous upper area 122 that defines the three apertures 121, and cover layers 120 each have an extended and narrower lower area 123. An advantage of apertures 121 is that the breathability of cover layers 120 is enhanced, thereby permitting moisture to escape from within apparel 100.

Figure 8A:
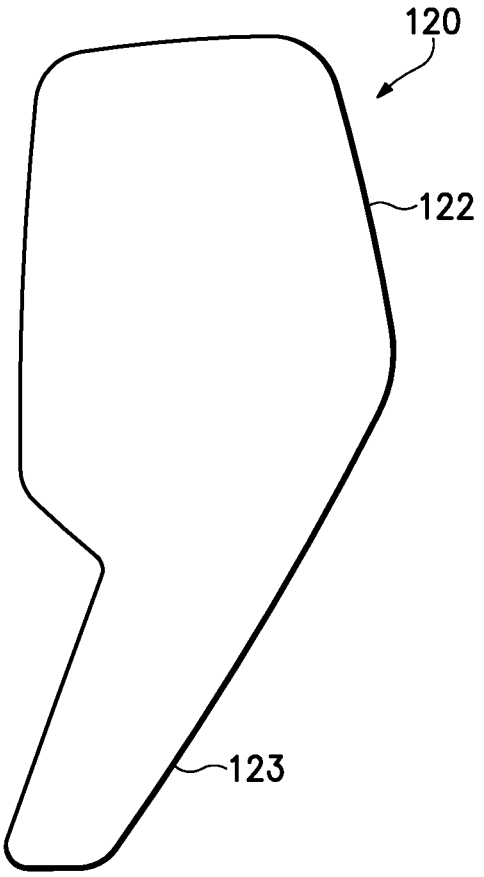
FIGS. 8A-8F are side elevational views of additional configurations of the first article of apparel.
Figure 8B:
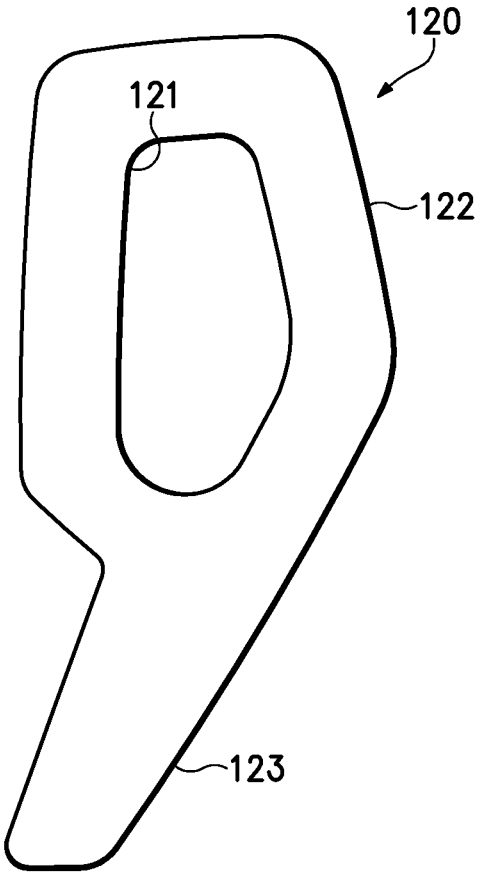
Figure 8C:
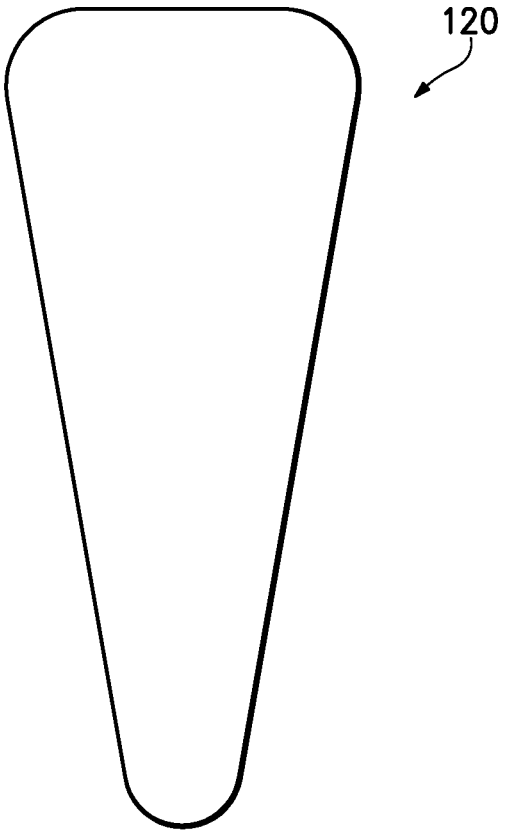
Figure 8D:
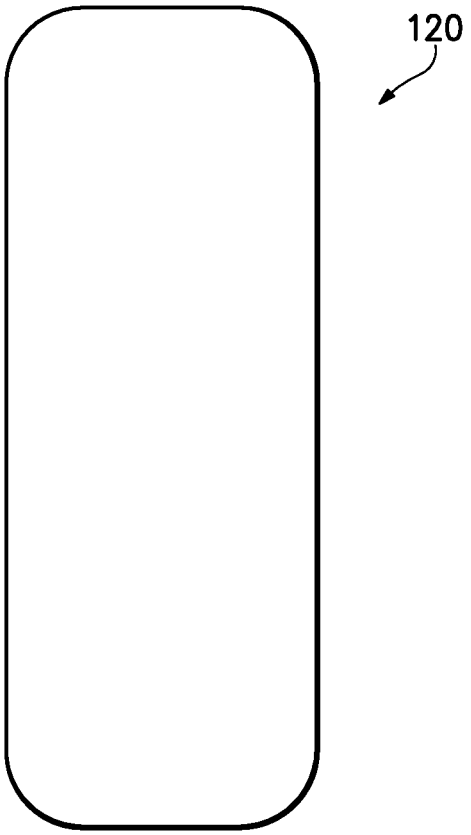
Figure 8E:
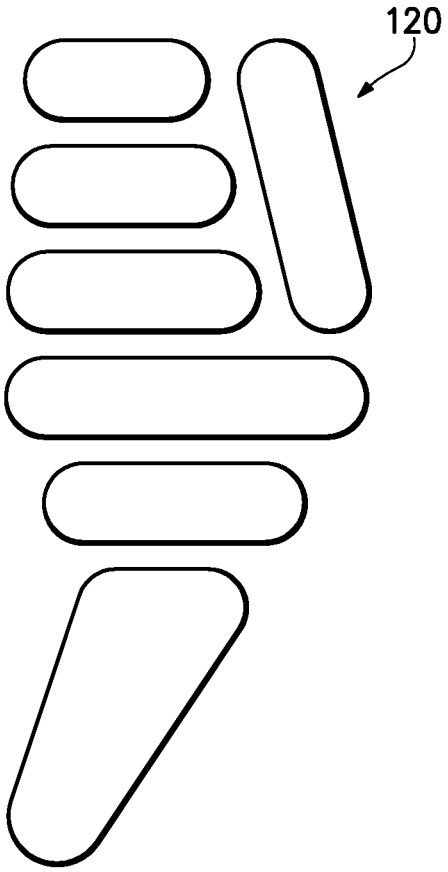
Figure 8F:
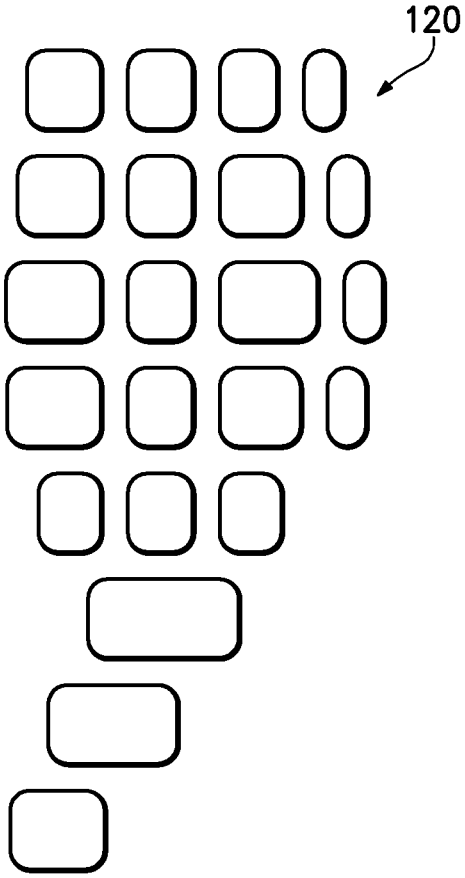

Although the configuration of covers layers 120 discussed above provides a suitable configuration for cover layers 120, a variety of other configurations may also be utilized. In some configurations, apertures 121 may be absent from cover layers 120, as depicted in FIG. 8A. As an alternative, cover layers 120 may define a single, larger aperture 121, as depicted in FIG. 8B. The overall shape may also vary such that cover layers 120 exhibit generally symmetrical shapes, such as triangular and rectangular, as depicted in FIGS. 8C and 8D. In some configurations, cover layers 120 may be formed from a plurality of discrete areas that impart the general shape discussed above, as depicted in FIG. 8E. Similarly, cover layers 120 may also be formed from discrete strips of material, as depicted in FIG. 8F. Accordingly, the specific configuration of cover layers 120 may vary to include a variety of shapes that impart any one or all of (a) a position corresponding with the femoral joints and sides of the legs, (b) a tapered configuration, (c) greater width in the areas corresponding with the femoral joints, and (d) greater coverage in rear area 116 than front area 115.

Figure 6:
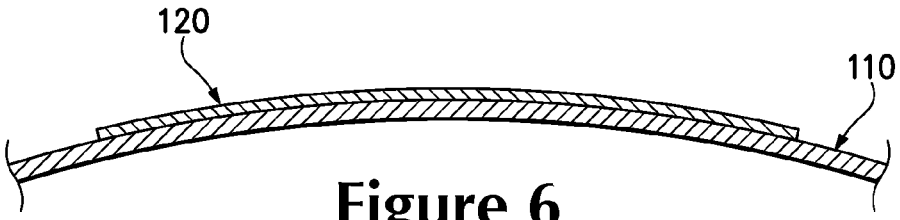
FIG. 6 is a partial cross-sectional view of the first article of apparel, as defined by section line 6-6 in FIG. 2.

Although stitching may be utilized to join cover layers 120 to base layer 110, various bonding methods may also be utilized. That is, an adhesive or thermobonding process may be utilized to seamlessly-join cover layers 120 to base layer 110. As depicted in the cross-section of FIG. 6, seamlessly-joining cover layers 120 to base layer 110 has an advantage of reducing the number of discontinuities in the areas of cover layers 120. In some configurations, the material forming cover layers 120 may be printed (e.g., screen printed), molded, or otherwise applied to the surface of base layer 110.

A variety of materials may be utilized for cover layers 120, including polymer sheets, textiles, and polymer-coated textiles, for example. As noted above, cover layers 120 impart relatively low friction areas to apparel 100. Materials that generally have lesser friction than base layer 110 may, therefore, be utilized for cover layers 120. As examples, cover layers 120 may be formed from a textile that is coated with polytetrafluoroethylene (e.g., TEFLON), or cover layers 120 may be formed from a two-layer polyurethane film or other polymer films supplied by BEMIS ASSOCIATES, Inc. of Shirley, Mass., United States. In addition, cover layers 120 may be formed from polyamide, polyester, polyolefin, or vinyl films that are bonded or otherwise secured to base layer 110. Accordingly, a variety of materials may be utilized for cover layers 120.

Figure 9:
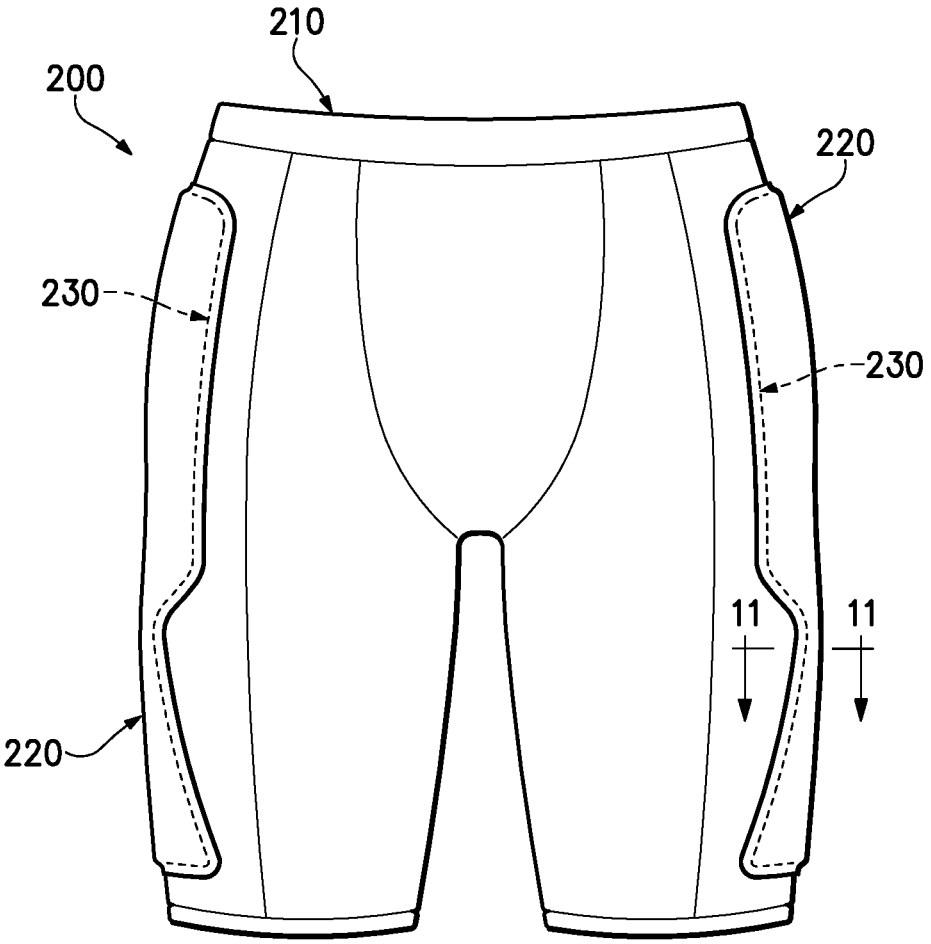
FIG. 9 is a front elevational view of a second article of apparel.
Figure 10:
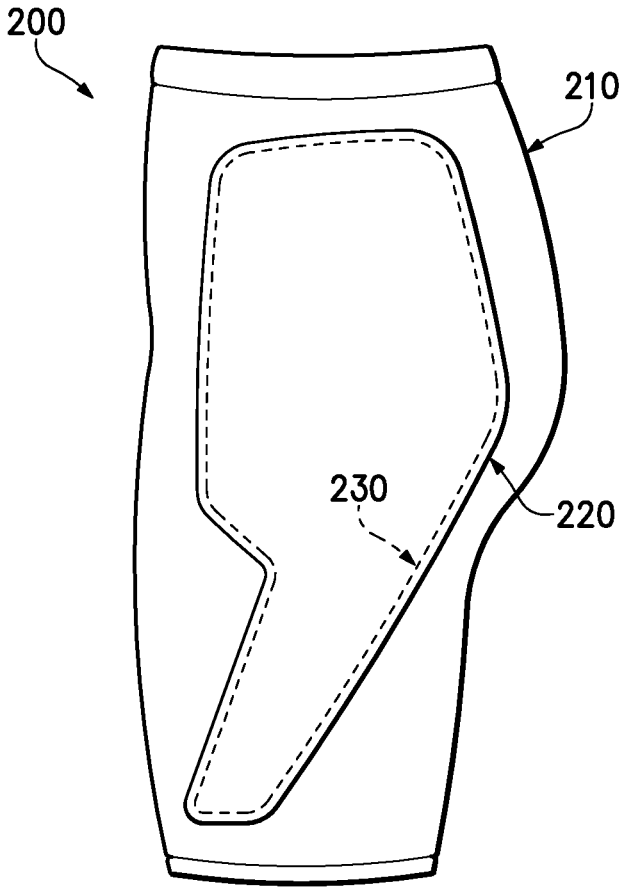
FIG. 10 is a side elevational view of the second article of apparel.

An article of apparel 200 is depicted in FIGS. 9 and 10 as including a base layer 210 and a pair of cover layers 220 that are secured to base layer 210. Whereas base layer 210 imparts the general configuration of the shorts-type undergarment to apparel 200, cover layers 220 impart relatively low friction areas and cushioning areas to apparel 200. As discussed in the Background section above, an athlete may incur a variety of injuries from sliding, including (a) friction burns or abrasive injuries that arise when clothing rubs against skin of the athlete (e.g., at the femoral joint) and (b) bruising or other types of compressive injuries that arise during impact between the body of the athlete (e.g., at the femoral joint) and the ground. As with apparel 100, cover layers 220 are located on base layer 210 at positions that correspond with the femoral joints and sides of the legs of individual 10 (or other individual wearing apparel 100) to reduce the degree to which base layer 210 causes friction burns or abrasive injuries at the femoral joints and legs during sliding. Additionally, apparel 200 incorporates a pair of cushioning elements 230 that impart cushioning to reduce the probability that bruising or other types of compressive injuries arise during sliding.

Figure 11:
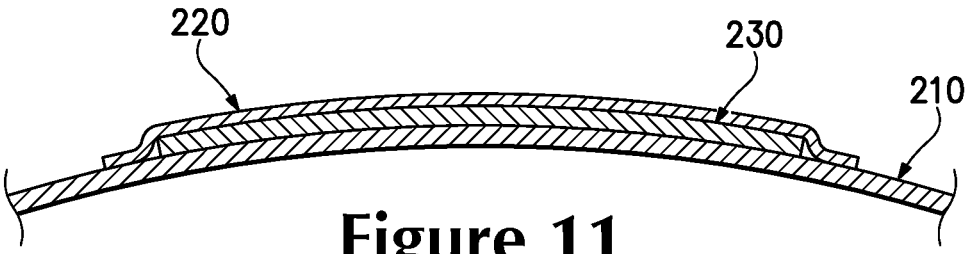
FIG. 11 is a partial cross-sectional view of the second article of apparel, as defined by section line 11-11 in FIG. 9.

Any of the materials and construction methods discussed above for base layer 110 and cover layers 120 may be utilized for apparel 200. Cushioning elements 230, which are located between cover layers 220 and base layer 210, as depicted in FIG. 11, may be formed from a variety of generally compressible materials. For example, cushioning elements 230 may be formed from a layer of polymer foam material (e.g., polyurethane or ethylvinylacetate), or cushioning elements 230 may be formed from fluid-filled structures.

Cover layers 220 and cushioning elements 230 are depicted as having (a) a position corresponding with the femoral joints and sides of the legs, (b) a tapered configuration, (c) greater width in the areas corresponding with the femoral joints, and (d) greater coverage in a rear area than a front area of apparel 200. Given these parameters, the specific shapes of cover layers 220 and cushioning elements 230 may vary significantly. As depicted in the figures, for example, cover layers 220 and cushioning elements 230 have shapes that resemble the numeral nine (i.e., "9") without an aperture, but may also include one or more apertures. In other configurations, the shapes of cover layers 220 and cushioning elements 230 may be similar to any of the configurations depicted in FIGS. 8A-8F. Although edges of cushioning elements 230 are depicted as being spaced inward from edges of cover layers 220, thereby permitting the edges of cover layers 220 to join directly with base layer 210, the edges of cushioning elements 230 may be flush with the edges of cover layers 220.

Although stitching may be utilized to join base layer 210, cover layers 220, and cushioning elements 230 to each other, various molding or bonding methods may also be utilized. That is, an adhesive or thermobonding process may be utilized to seamlessly-join the elements. As depicted in the cross-section of FIG. 11, seamlessly-joining the elements has an advantage of reducing the number of discontinuities in the areas of cover layers 220 and cushioning elements 230.

Figure 12:
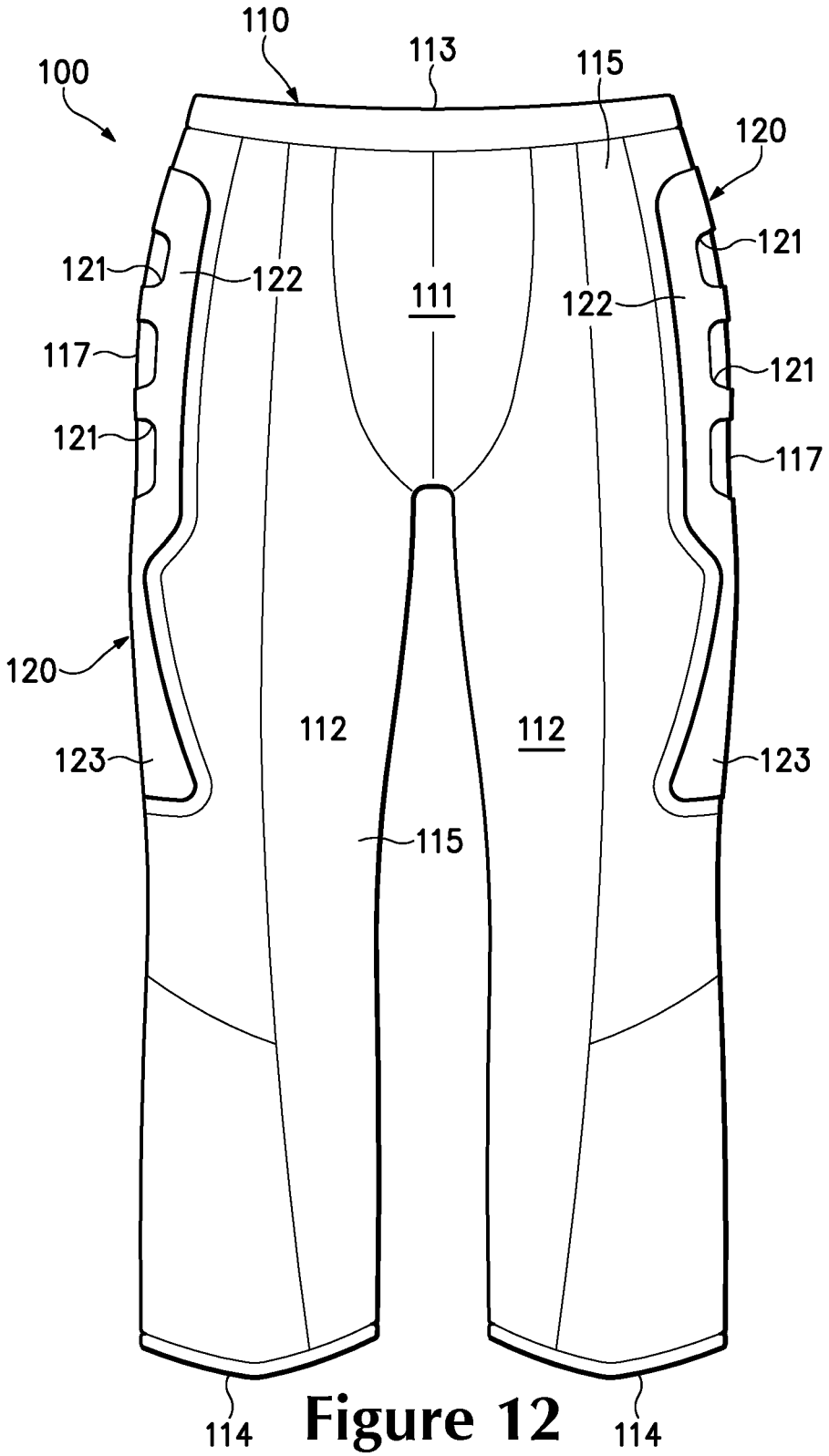
FIG. 12 is a front elevational view of another configuration of the first article of apparel.

Apparel 100 and apparel 200 are depicted as being a shorts-type undergarments. With respect to apparel 100, for example, the lengths of leg regions 112 may extend to the knees or ankles of individual 10, or leg regions 112 may be absent. As an example, FIG. 12 depicts a configuration of apparel 100 wherein leg regions 112 extend further downward and would extend beyond the knees of individual 10 when apparel 100 is worn.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a base layer having a pelvic region, a first leg region extending from the pelvic region, and a second leg region extending from the pelvic region, the base layer having an interior surface for contacting a wearer and an opposite exterior surface that faces away from the wearer, and the base layer being formed from a textile material; and a cover layer secured to the exterior surface of the base layer and positioned to extend from a side area of the pelvic region to a side area of the first leg region, the cover layer having a height extending from an area of the pelvic region defining a waist opening to an area of the first leg region defining a leg opening, a width of the cover layer along the height being greater in the pelvic region than the first leg region, and the cover layer being formed from a single material selected from a group consisting of (a) a polymer-coated textile, (b) a two-layer polymer film, and (c) a polyamide, polyester, polyolefin, or vinyl film, wherein the cover layer is bonded directly to the base layer without an intermediate layer positioned between the cover layer and the base layer.

2. The article of apparel recited in claim 1, wherein another cover layer is stitchlessly-secured to the exterior surface of the base layer and positioned to extend from an opposite side of the pelvic region to a side of the second leg region.

3. The article of apparel recited in claim 2, wherein a width of the another cover layer is greater in the pelvic region than the second leg region.

4. The article of apparel recited in claim 1, wherein the cover layer is formed from the two-layer polymer film, and wherein a frictional resistance of the exterior surface of the base layer is greater than a frictional resistance of a surface of the cover layer.

5. The article of apparel recited in claim 1, wherein a majority of an area of the cover layer is located in a rearward portion of the article of apparel.

6. The article of apparel recited in claim 1, wherein the cover layer has an interior surface facing the base layer and an exterior surface facing away from the wearer, and the cover layer defines at least one aperture that exposes the exterior surface of the base layer, the at least one aperture extending through the cover layer and from the interior surface of the cover layer to the exterior surface of the cover layer.

7. The article of apparel recited in claim 1, wherein the cover layer is formed from the polymer-coated textile, and wherein a frictional resistance of the exterior surface of the base layer is greater than a frictional resistance of a surface of the cover layer.

8. The article of apparel recited in claim 1, wherein the cover layer includes a side that faces towards the opposite exterior surface of the base layer and wherein substantially all of the side is bonded to the opposite exterior surface.

9. The article of apparel recited in claim 1, wherein the cover layer is stitchles sly-secured to the exterior surface of the base layer.

10. The article of apparel recited in claim 1, wherein the cover layer tapers between the pelvic region and the first leg region.

11. An article of apparel comprising:

a base layer having a pelvic region, a first leg region extending from the pelvic region, and a second leg region extending from the pelvic region, the base layer having an interior surface for contacting a wearer and an opposite exterior surface that faces away from the wearer;

a cover layer secured to the exterior surface of the base layer and positioned to extend from a side area of the pelvic region to a side area of the first leg region, a width of the cover layer being greater in the pelvic region than the first leg region, the cover layer having an interior surface facing the base layer and an exterior surface facing away from the wearer, the cover layer defining at least one aperture that extends through the cover layer and from the interior surface of the cover layer to the exterior surface of the cover layer, wherein the at least one aperture exposes at least one portion of the exterior surface of the base layer, and an exterior surface of the article of apparel includes the at least one portion of the exterior surface of the base layer; and a cushioning layer positioned between the base layer and the cover layer, wherein edges of the cushioning layer are spaced inward from edges of the cover layer.

12. The article of apparel recited in claim 11, wherein the base layer is formed from a textile material, and the cover layer is at least partially formed from a non-textile material.

13. The article of apparel recited in claim 11, wherein another cover layer is stitchlessly-secured to the exterior surface of the base layer and positioned to extend from an opposite side of the pelvic region to a side of the second leg region.

14. The article of apparel recited in claim 11, wherein a frictional resistance of the exterior surface of the base layer is greater than a frictional resistance of a surface of the cover layer.

15. The article of apparel recited in claim 11, wherein (a) an upper area of the pelvic region defines a waist opening, a lower area of the first leg region defines a first leg opening, and a lower area of the second leg region defines a second leg opening, (b) the cover layer has a height extending from the upper area of the pelvic region to the lower area of the first leg region, and (c) the width of the cover layer along the height is greater in the pelvic region than the first leg region.

16. An article of apparel comprising:

a base layer having (a) a pelvic region, (b) a first leg region extending from the pelvic region and having a lower area that defines a leg opening, and (c) a second leg region extending from the pelvic region and having a lower area that defines a leg opening, the base layer having an interior surface for contacting a wearer and an opposite exterior surface that faces away from the wearer;

a first cover layer having (a) a bulbous upper area positioned to correspond with a femoral joint and (b) a narrower lower area positioned to correspond with a side of a leg and extending from the upper area of the first cover layer to the lower area of the first leg region, a width of the first cover layer being greater in the pelvic region than in the first leg region, wherein a first cushioning layer is positioned between the base layer and the first cover layer, and wherein the first cover layer and the first cushioning layer define at least one void through the first cover layer and the first cushioning layer, the edges of the first cushioning layer being spaced inward from edges of the first cover layer and the edges of the first cover layer being secured to the exterior surface of the base layer, such that the at least one void exposes at least one first portion of the exterior surface of the base layer;

a second cover layer having (a) a bulbous upper area positioned to correspond with a femoral joint and (b) a narrower lower area positioned to correspond with a side of a leg and extending from the upper area of the second cover layer to the lower area of the second leg region, wherein a second cushioning layer is positioned between the base layer and the second cover layer, and wherein the second cover layer and the second cushioning layer define at least one void through the second cover layer and the second cushioning layer, the edges of the second cushioning layer being spaced inward from edges of the second cover layer and the edges of the second cover layer being secured to the exterior surface of the base layer, such that the at least one void exposes at least one second portion of the exterior surface of the base layer.

17. The article of apparel recited in claim 16, wherein the base layer is formed from a textile material and each of the first cover layer and the second cover layer are formed from non-textile materials.

18. The article of apparel recited in claim 16, wherein a frictional resistance of the exterior surface of the base layer is greater than a frictional resistance of surfaces of the first cover layer and the second cover layer.

19. The article of apparel recited in claim 16, wherein the first cushioning layer and the second cushioning layer are formed from a polymer foam material.

20. The article of apparel recited in claim 16, wherein edges of the first cover layer and edges of the second cover layer are secured to the exterior surface of the base layer by a bonding selected from a group consisting of an adhesive or a thermobond.

21. An undergarment comprising:

a base layer having a pelvic region, a first leg region, and a second leg region, an upper area of the pelvic region defining a waist opening, a lower area of the first leg region defining a first leg opening, and a lower area of the second leg region defining a second leg opening; and a single-layer, friction-reducing cover layer bonded directly to to an exterior surface of the base layer without an intermediate layer positioned between the cover layer and the base layer and extending from the upper area of the pelvic region to the lower area of the first leg region, an upper area of the single-layer, friction-reducing cover layer being positioned to correspond with a femoral joint and a lower area of the single-layer, friction-reducing cover layer being positioned to correspond with a side of a leg, and a width of the upper area of the single-layer, friction-reducing cover layer being greater than a width of the lower area of single-layer, friction-reducing cover layer, wherein a frictional resistance of the exterior surface of the base layer is greater than a frictional resistance of an exterior surface of the single-layer, friction-reducing cover layer to permit an article of apparel covering the undergarment to move relative to the undergarment.

22. The undergarment recited in 21, wherein the single-layer, friction-reducing cover layer is formed from a material selected from a group consisting of (a) a polymer-coated textile, (b) a two-layer polymer film, and (c) a polyamide, polyester, polyolefin, or vinyl film.

23. The undergarment recited in claim 21, wherein the single-layer, friction-reducing cover layer defines at least one or more apertures that extend through the single-layer, friction-reducing cover layer to expose one or more portions of the exterior surface of the base layer, and an exterior surface of the article of apparel includes the one or more portions of the exterior surface of the base layer.

* * * * *